US005957726A

United States Patent [19]

Belopolsky et al.

[11] Patent Number: 5,957,726

[45] Date of Patent: Sep. 28, 1999

[54] SHIELD FOR MODULAR JACK

[75] Inventors: Yakov Belopolsky, Harrisburg; Peter D. Curwen, York Haven, both of Pa.

[73] Assignee: Berg Technology, Inc., Reno, Nev.

[21] Appl. No.: 08/936,105

[22] Filed: Sep. 23, 1997

Related U.S. Application Data

[62] Division of application No. 08/690,548, Jul. 31, 1996, Pat. No. 5,788,538.

[51] Int. Cl.[6] ..... H01R 13/648

[52] U.S. Cl. ..... 439/607; 439/939

[58] Field of Search ..... 439/607, 609, 439/939

[56] References Cited

U.S. PATENT DOCUMENTS

| | | | |
|---|---|---|---|
| 4,386,814 | 6/1983 | Asick | 339/14 R |
| 4,655,532 | 4/1987 | Hillis et al. | 339/143 R |
| 4,820,885 | 4/1989 | Lindsay | 174/35 GC |
| 4,838,811 | 6/1989 | Nakamura et al. | 439/607 |
| 4,878,858 | 11/1989 | Dechelette | 439/607 |
| 4,889,958 | 12/1989 | Takahashi et al. | 174/35 MS |
| 4,936,795 | 6/1990 | Kawai et al. | 439/609 |
| 4,938,714 | 7/1990 | Kawai et al. | 439/607 |
| 4,943,244 | 7/1990 | Teck et al. | 439/567 |
| 4,966,637 | 10/1990 | Laborie | 156/47 |
| 4,980,516 | 12/1990 | Nakagawa | 174/35 GC |
| 4,983,127 | 1/1991 | Kawai et al. | 439/79 |
| 4,993,971 | 2/1991 | Matsuzaki et al. | 439/607 |
| 5,022,871 | 6/1991 | Sekiguchi | 439/609 |
| 5,072,070 | 12/1991 | Balsells | 174/35 GC |
| 5,083,945 | 1/1992 | Miskin et al. | 439/607 |
| 5,091,606 | 2/1992 | Balsells | 174/35 GC |
| 5,147,121 | 9/1992 | McIlwraith | 312/296 |
| 5,162,980 | 11/1992 | Morgan et al. | 361/424 |
| 5,178,562 | 1/1993 | Ermini | 439/609 |
| 5,195,911 | 3/1993 | Murphy | 439/607 |
| 5,204,496 | 4/1993 | Boulay et al. | 174/35 GC |
| 5,207,597 | 5/1993 | Kline et al. | 439/607 |
| 5,228,872 | 7/1993 | Liu | 439/607 |
| 5,288,248 | 2/1994 | Chen | 439/609 |
| 5,348,484 | 9/1994 | Sorrentino | 439/101 |
| 5,364,574 | 11/1994 | Panayappan et al. | 264/46.6 |
| 5,378,172 | 1/1995 | Roberts | 439/607 |
| 5,383,098 | 1/1995 | Margate et al. | 361/818 |
| 5,397,250 | 3/1995 | Briones | 439/620 |
| 5,418,023 | 5/1995 | Hernandez et al. | 428/36.5 |
| 5,496,195 | 3/1996 | Reed | 439/607 |
| 5,511,992 | 4/1996 | Thalhammer | 439/609 |

FOREIGN PATENT DOCUMENTS

| | | | |
|---|---|---|---|
| 627791-A1 | 12/1994 | France | 23/68 |

OTHER PUBLICATIONS

IBM Technical Disclosure Bulletin, vol. 30, No. 6, Nov. 1987.

*Primary Examiner*—Gary F. Paumen
*Attorney, Agent, or Firm*—Daniel J. Long; M. Richard Page

[57] ABSTRACT

Disclosed is a metallic shield for a modular jack which includes a first member which is superimposed over the top and lateral wall of the jack. A second member surrounds the front plug openings. A first tab on the second member engages an aperture on the first member. A second tab on the second member curves rearwardly and upwardly then rearwardly and downwardly to abut the first member. A third tab on the second member curves rearwardly and upwardly to engage a panel.

1 Claim, 4 Drawing Sheets

SHIELD FOR MODULAR JACK

This application is a division of application Ser. No. 08/690,548, filed Jul. 31, 1996, now U.S. Pat. No. 5,788,538 issued Aug. 4, 1998.

BACKGROUND OF THE INVENTION

1. Field of the Invention

The present invention relates to electrical connectors and more particularly to modular jacks.

2. Brief Description of Prior Developments

Modular jacks are well known for telecommunications and computer networking purposes. These jacks usually include a rectangular opening with at least one upper keyway. A plug having a rectangular cross section and lower surface contacts and an upper key lock is inserted into the jack. Upon such insertion, the upper key lock snaps into a locking position with the upper keyway of the jack, and the lower surface contacts on the plug are engaged by contacts in the jack.

For various purposes, particularly for high speed data communications, it is necessary that modular jacks be shielded from electromagnetic interference (EMI). A number of shielding arrangements are suggested by the prior art, but a shield which allows for a low inductance path to ground and multiple contacts with a front equipment panel is still needed.

SUMMARY OF THE INVENTION

The modular jack of the present invention includes shielding which provides an affective scaled shielding of the modular jack and for a low inductance path to ground and multiple contacts with a front equipment panel. In one preferred embodiment, this assembly comprises an insulative housing comprising first and second longitudinal walls positioned such that said second longitudinal wall is superimposed over said first longitudinal wall in spaced parallel relation. At least one pair of lateral walls is interposed between the first and second longitudinal walls to form at least one transverse plug receiving cavity having a front opening. A metallic shield includes a first member and second member. The front member is superimposed over the second longitudinal wall of the housing. The second shield member surrounding the front opening of the transverse plug receiving cavity and is perpendicularly adjacent the front edge of the first shield member. A first connecting means which may be a clip with two resilient legs fastens the second shield member to the first shield member. The second shield member also has a tab which extends upwardly and rearwardly then downwardly and rearwardly to laterally abut the first member. A second tab extends rearwardly and upwardly adjacent said first tab. A panel positioned outwardly adjacent the upwardly extending section of the second tab flexes the first tab against the first member of the shielding. This arrangement is preferably repeated at spaced intervals along the front edge of the first shield member.

BRIEF DESCRIPTION OF THE DRAWINGS

The modular jack of the present invention is further described with reference to the accompanying drawings in which.

DETAILED DESCRIPTION OF THE PREFERRED EMBODIMENTS

Figure 1:
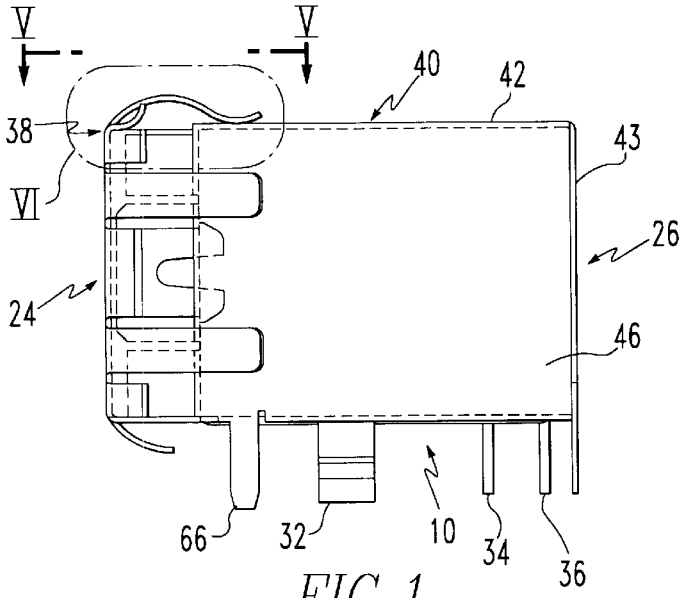
FIG. 1 is a side elevational view of the modular jack of the present invention.

Referring to FIGS. 1–4, the modular jack of the present invention includes an insulative housing shown generally at numeral 10. This housing includes a lower horizontal longitudinal wall 12 and an upper horizontal longitudinal wall 14. The housing also includes end lateral walls 16 and 18 as well as a plurality of intermediate lateral walls as at 20. Adjacent lateral walls as at 18 and 20 form plug receiving cavities as at 22. Each of these plug receiving cavities has a front open end 24 and a rear end 26. In each plug receiving cavity there is a medial wall 28 and steps as at 30 to form a key structure. The modular jack also includes mounting pins as at 32 and conductive terminals as at 34 and 36. The modular jack also includes a metallic shield shown generally at numeral 38. The metallic shield includes a first lateral member shown generally at 40 which has a horizontal wall 42 which is superimposed over upper horizontal wall 14 of the insulated housing. The first lateral portion 44 also includes a rear vertical wall 43 superimposed over rear end 26 and a lateral vertical wall 44 which is superimposed over lateral wall 16 of the insulated housing and lateral vertical wall 46 which is superimposed over lateral wall 18 of the insulated housing. The first lateral member of the shield has a front peripheral edge 48, and rearwardly spaced from this edge there is a peripheral step 50. At spaced peripheral intervals there are additional deeper recesses, 52, 54, 56, 58, 60 and 62. Each of those recesses has an engagement aperture as at aperture 64 in recess 60. The first lateral member of the shield also includes grounding pins such as pin 66. The shield also includes a second vertical member which is shown generally at numeral 70. This second vertical member of the shield is engaged to the first lateral member of the shield by a system clips which is explained as follows.

Figure 5:
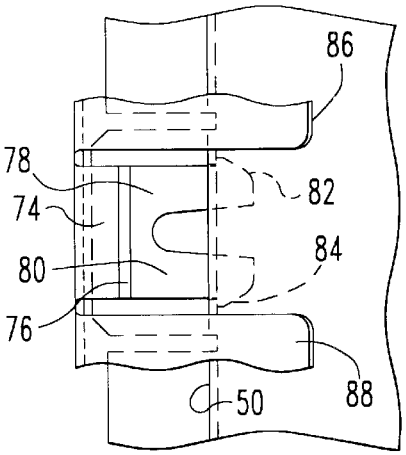
FIG. 5 is a detailed view from V—V in FIG. 1.
Figure 6:
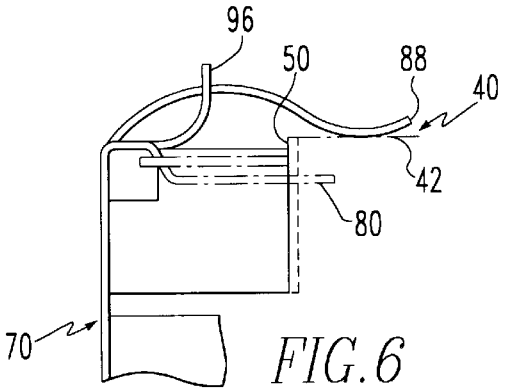
FIG. 6 is a detailed view of area VI in FIG. 1.
Figure 2:
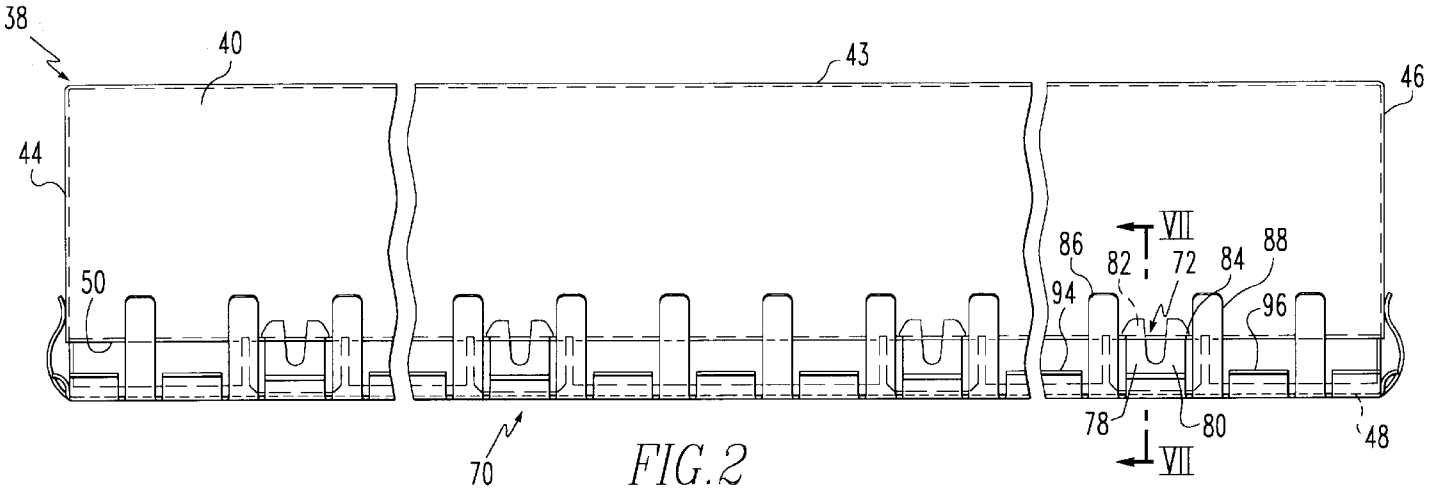
FIG. 2 is a fragmented top plan view of the modular jack shown in FIG. 1.
Figure 3:
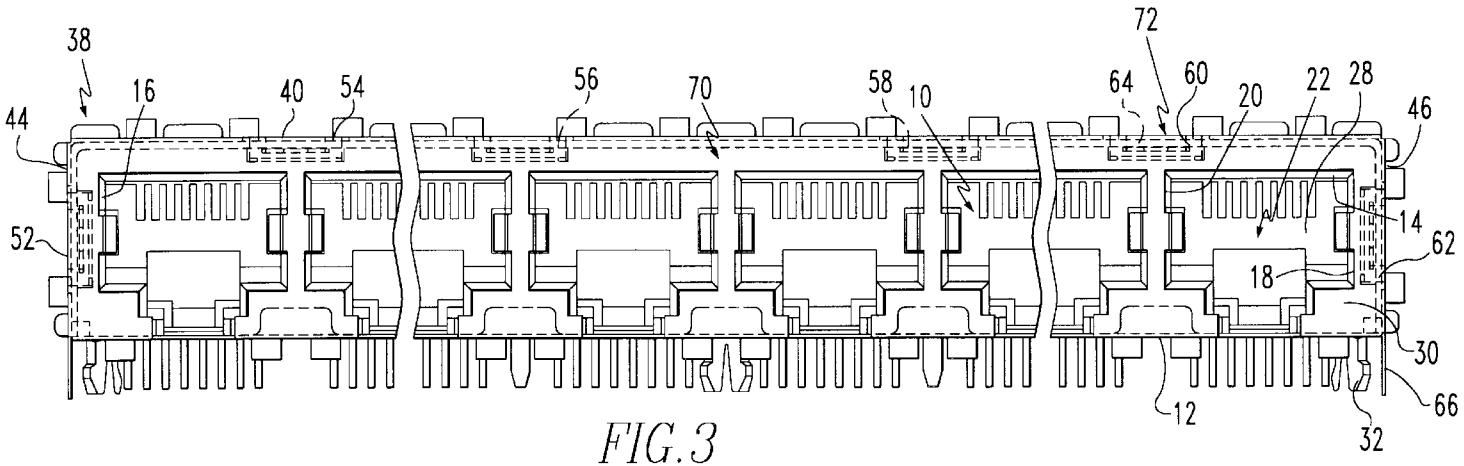
FIG. 3 is a fragmented front elevational view of the modular jack shown in FIG. 1.
Figure 7:
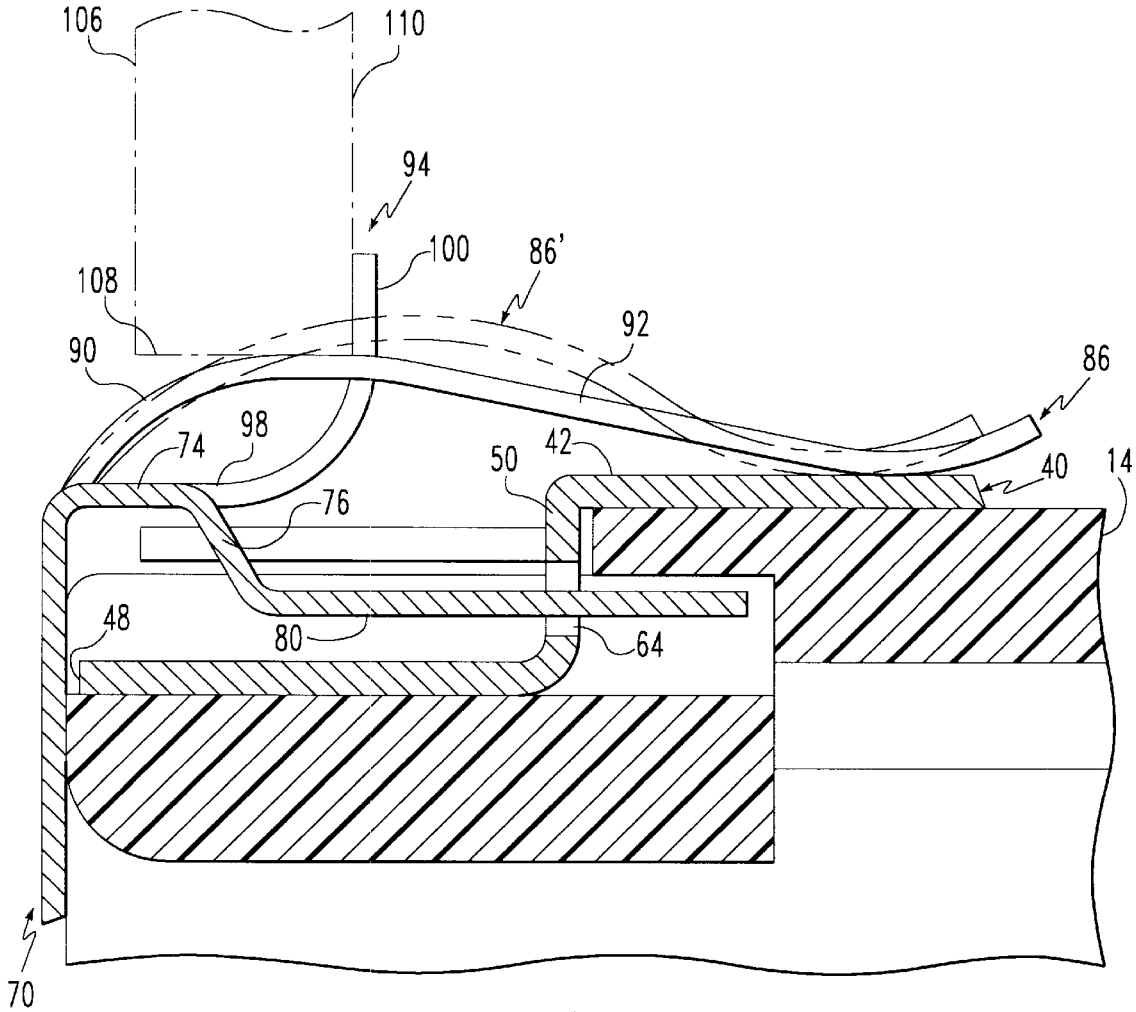
FIG. 7 is a schematic cross sectional view through VII—VII in FIG. 2 showing the operation of the shielding used in the modular jack of the present invention.

There are a number of first recess engaging clips shown generally at numeral 72. Referring to FIGS. 5–7, each of these recess engaging clips includes a rearward extension 74, a downward oblique section 76 and a pair of rearwardly extending legs 78 and 80 which have, respectively, rearward outwardly extending projections 82 and 84. These legs pass through recess apertures as at aperture 64 and the projections 82 and 84 grasp the edges of the apertures. Outwardly adjacent each of the recess engaging clips there are a pair of generally horizontal tabs as at 86 and 88.

Referring particularly to FIG. 7, it will be seen that each of these tabs has an upwardly and rearwardly curved section 90 and then a downwardly and rearwardly curved section 92 which abuts the first lateral section 40 of the shield. Outwardly adjacent the horizontal tabs as at 86 and 88 there is a pair of generally vertical tabs as at 94 and 96. Each of these tabs has a rearwardly extending section 98 and an upwardly extending section 100. The three sets of tabs are used at spaced intervals along the peripheral edge 48 of the first member to effectively seal the modular jack from EMI. The use of multiple tabs also serves to effectively ground the shield and the modular jack.

Figure 4:
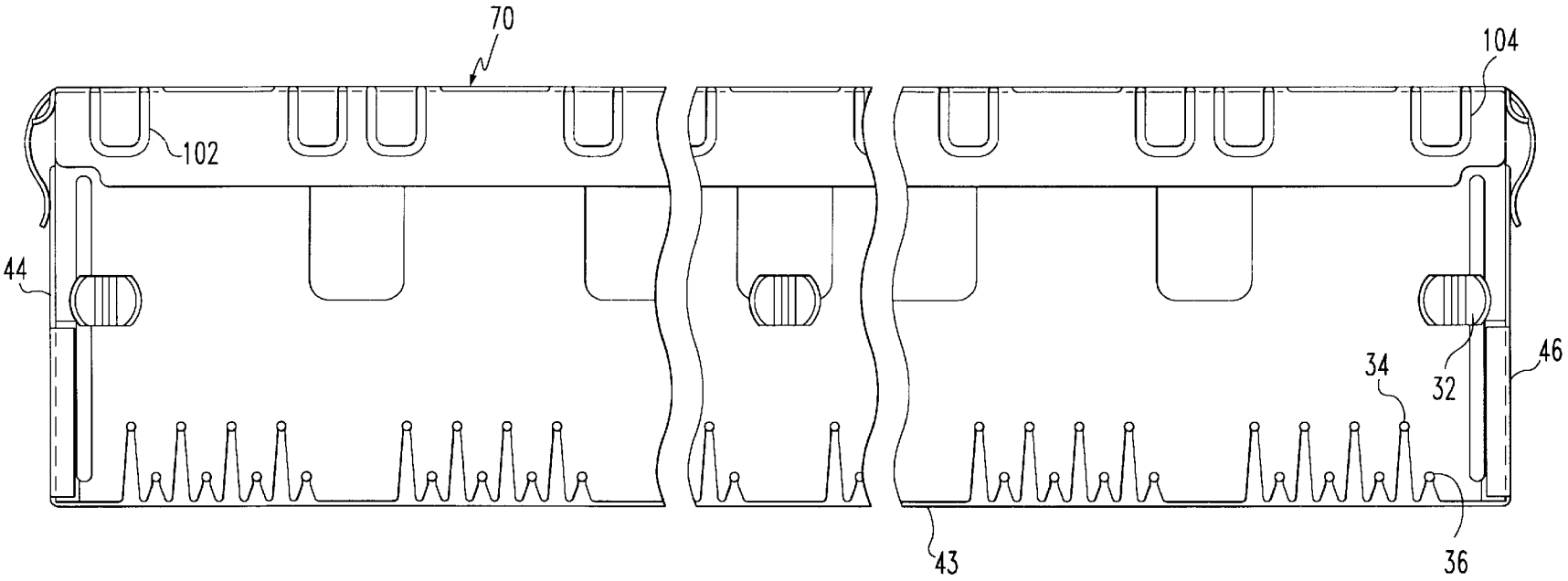
FIG. 4 is a fragmented bottom plan view of the modular jack shown in FIG. 1.

Referring particularly to FIG. 4, it will be seen that the front section 70 of the shield is also engaged to the lower longitudinal wall 12 by means of lower horizontal clips as at clips 102 and 104.

Referring again particularly to FIG. 7, it will be seen the modular jack is engaged with a panel 106 that the second horizontal clips as at 86 will be flexed by the lower edge 108 of the panel from the relaxed position at 86. It will also be seen that the generally vertical tabs as at 94 will engage the rear side 110 of the panel to firmly engage the panel and allow for effective shielding of the modular jack.

It will be appreciated that a means for effectively sealing a modular jack from EMI is provided. It will also be appreciated that a low inductance path to ground through multiple contacts is provided.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiments, but rather construed in breadth and scope in accordance with the recitation of the claims.

What is claimed is:

1. A metallic shield for a modular jack having a front and rear side and opposed top and bottom walls and lateral walls, said shield comprising a first member having a front edge and superimposed over the top wall of the modular jack and a second shield member superimposed over at least part of the front side of the modular jack and having a first connecting means to engage the first shield member and a second connecting means which extends rearwardly from the second shield member to abut the first shield member, and the second connecting means is a tab which curves first upwardly and rearwardlv and then curves downwardly and rearwardly and there is a third connecting means adjacent said second connecting means which first curves rearwardly then upwardly to facilitate mounting the modular jack on a panel.

* * * * *